US006685390B1

(12) United States Patent
Eitzen

(10) Patent No.: US 6,685,390 B1
(45) Date of Patent: Feb. 3, 2004

(54) INVERTED TRUSS SCREED WITH OUTRIGGER SUPPORT

(76) Inventor: Wayne Eitzen, 1 Sawston La., Bella Vista, AR (US) 72714-4321

( * ) Notice: Subject to any disclaimer, the term of this patent is extended or adjusted under 35 U.S.C. 154(b) by 0 days.

(21) Appl. No.: 10/123,376

(22) Filed: Apr. 15, 2002

(51) Int. Cl.[7] ..... E01C 19/22; E01C 19/42

(52) U.S. Cl. ..... 404/119; 404/84.1; 404/118

(58) Field of Search ..... 404/100, 101, 404/102, 103, 105, 106, 118, 119, 120, 114, 115

(56) References Cited

U.S. PATENT DOCUMENTS

| | | | | | |
|---|---|---|---|---|---|
| 3,110,234 | A | | 11/1963 | Oster | 94/45 |
| 3,299,786 | A | | 1/1967 | Godbersen | 94/45 |
| 3,541,931 | A | | 11/1970 | Godbersen | 94/45 |
| 3,593,627 | A | | 7/1971 | Rowe et al. | 94/45 |
| 3,807,887 | A | * | 4/1974 | Tate | 404/84.2 |
| 4,340,351 | A | * | 7/1982 | Owens | 425/456 |
| 4,655,633 | A | * | 4/1987 | Somero et al. | 404/75 |
| 4,676,690 | A | * | 6/1987 | Allen | 404/110 |
| 5,288,166 | A | * | 2/1994 | Allen et al. | 404/84.1 |
| 5,533,831 | A | | 7/1996 | Allen | 404/114 |
| 5,729,940 | A | * | 3/1998 | Bullivant | 52/299 |
| 5,988,939 | A | | 11/1999 | Allen et al. | 404/116 |

* cited by examiner

*Primary Examiner*—Thomas B. Will
*Assistant Examiner*—Alexandra K. Pechhold
(74) *Attorney, Agent, or Firm*—Keisling Pieper & Scott PLC; Trent C. Keisling; David B. Pieper

(57) ABSTRACT

A screed with a trussed beam having a cross-section in the geometrical shape of an equilateral triangle used to support tools for working plastic concrete. The beam is supported between spaced apart, wheeled carriages riding forms bounding the plastic concrete. The beam is oriented such that the cross-sectional triangle is inverted with the wide base at the screed top and the apex at the bottom. The inverted triangular truss beam has sufficient space to suspend working tools substantially within the peripheral edges of the beam. The screed uses upstanding integral outriggers so that the pitch at the center of the screed can be adjusted exteriorly to the pour site.

19 Claims, 6 Drawing Sheets

INVERTED TRUSS SCREED WITH OUTRIGGER SUPPORT

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates generally to concrete screeding apparatus for placing, consolidating and finishing plastic concrete. In particular, the present invention relates to an inverted triangular truss modular screed with an outrigger support. Relevant art may be found in U.S. Class, subclasses 101, 114, 115, as well as others.

2. Description of the Known Art

As will be appreciated by those skilled in the art, wet or plastic concrete must be worked before it sets and forms a hardened slab. Working plastic concrete generally involves consolidating the plastic concrete to evenly distribute water and aggregates throughout the resulting monolith and, subsequently, leveling and finishing the consolidated plastic concrete to appropriately contour the top layer of the plastic concrete.

Consolidating plastic concrete is often performed by vibrating the plastic concrete to evenly distribute water and aggregate materials throughout the monolith of concrete. The vibrations also fracture air pockets trapped inside the monolith and permit the air to escape therefrom. Other pockets of materials, such as sand and gravel or the like, are also shattered so that their components may be more evenly distributed throughout the monolith.

Several tools have been previously proposed for working plastic concrete. These tools include screeds, trowels (both manual and self-propelled), and other tools such as floating pans and the like. Of the former, screeds with strike-offs are commonly employed during initial plastic concrete consolidation while the other types are typically used to finish the top surface of the concrete to a desired smoothness.

Form riding screeds are typically at least ten feet in length and ride upon the forms bounding the concrete monolith. These form-riding screeding apparatus are usually pulled along the form by a series of cables or the like and generally employ remote power to vibrate the smoothing blade. Examples of conventional form-riding screeds are shown in U.S. Pat. Nos. 3,299,786 and 3,541,931.

Screeds may generally be grouped according to the number of operators needed to operate them, support mechanisms necessary for their proper operation, structural shapes, or other meaningful characteristics. It is not uncommon for a screed to meet the criteria for several groups. Screeds with strike-offs are normally employed in "wet" plastic concrete to initially level and consolidate the monolith because the wet plastic concrete typically will not support heavy weights. ("Wet" plastic concrete generally has a slump of between three and ten inches.)

Exemplary multiple operator screeds are shown in U.S. Pat. Nos. 3,110,234, 3,299,786, 3,541,931 and 3,593,627. These devices generally strike-off, vibrate and level plastic concrete in a single pass. They may employ remote power and are typically drawn through plastic concrete by multiple operators. However, they are large and unwieldy and they often require excessive site preparation and cannot be moved quickly about the pour. These devices also suffer from other handicaps associated with maintenance and the like. The configuration of their truss system is such that the vibratory mechanism and strike off blades are essentially an integral part of the screed. As a result of this configuration, the vibrations shake the entire unit, which makes continuous adjustment of alignment characteristics during the screeding operation a matter of course. The concrete leveling blades need to be changed to provide for different finish textures and the like. The strike-off blades occasionally need to be changed to accommodate different plastic concrete mixes. As will be appreciated by those skilled in the art, changing blades on existing screeds requires considerable time.

U.S. Pat. No. 3,110,234 to Oster shows a concrete screeding machine with a rectangular cross-sectional truss beam. The device employs oppositely moving screeds (rather than vibrating screeds) to eliminate side thrust. The device does not utilize supporting outriggers to prevent sagging or to maintain a selected alignment pitch nor does it utilize an inverted triangle truss to support concrete-finishing elements centrally.

U.S. Pat. No. 3,299,786 to Godbersen shows a bridge deck finisher that utilizes a rectangular cross-section truss beam. The apparatus uses spring urging toward the concrete to provide resiliency. The apparatus does not utilize supporting outriggers to prevent sagging or to maintain a selected alignment pitch nor does it utilize an inverted triangle truss to support concrete-finishing elements centrally.

U.S. Pat. No. 3,541,931 to Godbersen shows a concrete finishing mechanism having an adjustable rotating drum. While this device is of only marginal relevance, it too employs a rectangular cross-section truss beam. The device does not utilize supporting outriggers to prevent sagging or to maintain a selected alignment pitch nor does it utilize an inverted triangle truss to support concrete-finishing elements centrally.

U.S. Pat. No. 3,593,627 to Rowe et al. shows a concrete finishing machine movable longitudinally of a road and having a pair of oppositely reciprocating finishing members movable transversely back and forth across the road. The device utilizes a rectangular cross-section truss beam to support the finishing members. The device employs elongated adjustment rods to enable the device to accommodate crowns on roads. The device does not utilize supporting outriggers to prevent sagging or to maintain a selected alignment pitch nor does it utilize an inverted triangle truss to support concrete-finishing elements centrally.

U S. Pat. No. 5,533,831 to Allen shows an obstacle bypass system for concrete finishing tools. The device utilizes a rectangular cross-section to support the finishing members. The device employs pivoting members to enable the device to retract to bypass obstacles. The device does not utilize supporting outriggers to prevent sagging or to maintain a selected alignment pitch nor does it utilize an inverted triangle truss to support concrete-finishing elements centrally.

U.S. Pat. No. 5,988,939 to Allen et al. shows a universal bridge deck vibrating system that utilizes a translating carriage atop a conventional rectangular cross-sectioned beam screed. The device does not utilize supporting outriggers to prevent sagging or to maintain a selected alignment pitch nor does it utilize an inverted triangle truss to support concrete-finishing elements centrally.

Thus, there exists a need in the art for a vibratory screed that may be easily transported about a pour site as well as from pour site to pour site, with minimal preparation time required before use to consolidate and level plastic concrete. The screed width needs to be easily adjustable to accommodate a large range of spans. The working or finishing tools, such as strike-off blades and leveling bars, need to be easily removable to accommodate various concrete mixes that might be spread and the desired texture of the finished concrete monolith. A particularly advantageous apparatus would use a dependable vibratory dispersion system that dampens vibration transmission to the truss system while preventing undesirable down time for camber or pitch adjustments to promote efficient concrete consolidation and leveling.

A need also exists for an improved multiple operator vibratory concrete screeding apparatus that has vibration dampening between the vibratory mechanisms and the trussed beam, has easily changeable strike-off and leveling blades, and has easily adjustable alignment mechanisms, especially for pitch camber alignment.

SUMMARY OF THE INVENTION

In accordance with one exemplary embodiment of the present invention, a screed with a trussed main beam having a cross-section in the geometrical shape of an equilateral triangle is used for finishing concrete. This beam is oriented such that the equilateral triangle is turned upside down or inverted with the wide base at top and the bottom pointed toward the concrete being worked upon below the screed. The inverted triangular truss beam gives sufficient space to mount working tools, such as a leading scraper or strike-off or leveling blade as well as a trailing smoothing tool or bar more closely within or substantially within the peripheral edges of the screed beam rather than being placed a substantial distance in front or behind the main screed beam. In this position, the tools or blades are stabilized by the weight of the beam and do not unduly torsion the supporting truss system. This reduction in torsion is primarily due to reduction in the lever multiplier effect for locations forward or behind the screed beam.

The screed has several primary members including carriage assemblies, a concrete spanning beam from which tools are suspended and uprising outriggers. The screed is adapted to be used to work plastic concrete to produce a desirably formed monolith in a single pass. The screed rides on forms bounding the plastic concrete on spaced apart, wheeled end carriage assemblies. The main trussed beam extends between the carriage assemblies and it is thus supported over the plastic concrete to be worked.

In use, the carriage assemblies ride on the forms bounding a concrete pour site while the beam passes over the concrete therebetween. Any tools suspended by the beam can thus work on the concrete passing beneath the beam in a conventional fashion to produce a desirably finished concrete monolith.

Usually only one concrete finishing tool is mounted before and one aft of the main trussed beam. As a result of the particular geometry of the inverted triangle truss beam, there is sufficient space on the quick connector to mount additional concrete finishing tools if desirable.

The main beam has spaced apart ends, each of which include a terminal steel plate that has the same dimensions as the trussed beam and which mate with corresponding coupling points on each carriage. At each beam end, an outrigger assembly is captivated between the beam end and the carriage assembly.

Each outrigger includes a front and rear stanchion. Each stanchion rises above the plane of formed by the truss base. A front and rear adjustment bar extends inwardly from the front and rear stanchion to a point proximate the beam midpoint where they are anchored to the beam. The front and rear adjustment bars may be selectively lengthened or shortened to change the pitch or alignment of the screed to vary the angle of attack for the suspended tools or the resultant shape of the concrete monolith produced by the screed.

The terminal beam plates and the other primary members have triangular slots adapted to receive short alignment members that facilitate coupling abutting members. Thus, the primary members may be transported in an unassembled state and quickly assembled at a job site.

In one exemplary embodiment in accordance with the present invention, the main trussed beam includes several sections of modular design. The sections or modules can include only the main beam or they can include concrete finishing tools. The latter is preferential since at a minimum each main trussed beam module will have a leading working tool such as a scraper or strike-off blade and a finishing tool such as a vibrator or a vibrator bar attached. Individual modules can range from 2.5 feet to 10 feet in width. As a result of the different sizes, combinations of modules can be assembled in any configuration to meet the width requirement of the job at hand. The ends of the modules are shaped for quickly attaching one to another in their central trussed beam geometry. The modules are coupled together with bolts through holes in their respective steel end plates.

The ends of each main beam module have reinforcing steel bands located next to the steel end plate. Longer modules can have these reinforcing bands spaced along them. In addition to providing extra strength, these bands can serve as attachment locations both in front of as well as behind the main trussed beam for "quick connecting" concrete finishing tools. This "quick connection" utilizes a common geometrical configuration for attaching concrete finishing tools to the main inverted triangle trussed beam which results in a system that makes attaching various concrete finishing tools to the inverted triangle trussed beam simplistic. In one exemplary embodiment, the common geometrical configuration is a bracket that has a cross section in the shape of an equilateral triangle whose dimensions are determined by the distance in front of or behind the main beam it is desired for the concrete finishing tool to operate as well as their mounting height.

In addition, the leveling blade as well as the vibratory bar may each be attached with only one bolt at each reinforcing band of a main beam module. Anti-vibration components can be included as desired at the points of attachment of vibratory bars to the "quick connector" framework as well as where the "quick connector" attaches to the main trussed beam. Vibration control is further enhanced by isolating the source of the vibration by having small vibrators mounted on the vibratory bar for each module.

During setup, the inverted triangle trussed beam screed is aligned and adjusted to give the desired surface crown. Even with the dampened vibrations acting on the screed, the vibrations are such that the screed can be shaken out of alignment. Thus, continual alignment adjustments may need to be made during operation. Since the screed has outriggers, the pitch or alignment of the screed can be adjusted outside of or exteriorly from the pour site. Thus, the operator is not required to walk through the plastic concrete to make these adjustments. This is preferential since walking through the plastic concrete is to be avoided as it disturbs the concrete by leaving depressions and imperfections in the concrete or it slows the process by stopping the forward movement of the screed. The outriggers also support the center of the screed from the outer edges of the screed, which is especially important for longer spans.

Thus, a principal object of the present invention to provide a concrete leveling and finishing apparatus that enhances and improves concrete leveling and finishing operations.

A basic object of the present invention is to provide a concrete finishing apparatus for which a selected pitch may be easily implemented and maintained.

Another basic object of the present invention is to provide a concrete finishing device that minimizes torsion stresses by positioning leading and trailing tools centrally.

Another object of the present invention is to provide substantial weight reduction in a concrete screeding apparatus without a reduction in its strength.

Yet another object of the present invention is to provide a method of adjusting the pitch of a screed without requiring operators to enter poured plastic concrete.

Another object of the present invention is to provide a method of quickly changing the leveling blades and smoothing bars of a concrete finishing apparatus.

Yet another object of the present invention is to provide a means for dampening vibrations upon a concrete finishing apparatus.

A further object of the present invention is to provide a means to accommodate various span widths by using module units of various lengths that can be assembled in any order or combination.

An object of the present invention is to provide a concrete finishing apparatus that can be assembled and disassembled rapidly to facilitate transport among job sites.

These and other objects and advantages of the present invention, along with features of novelty appurtenant thereto, will appear or become apparent in the course of the descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
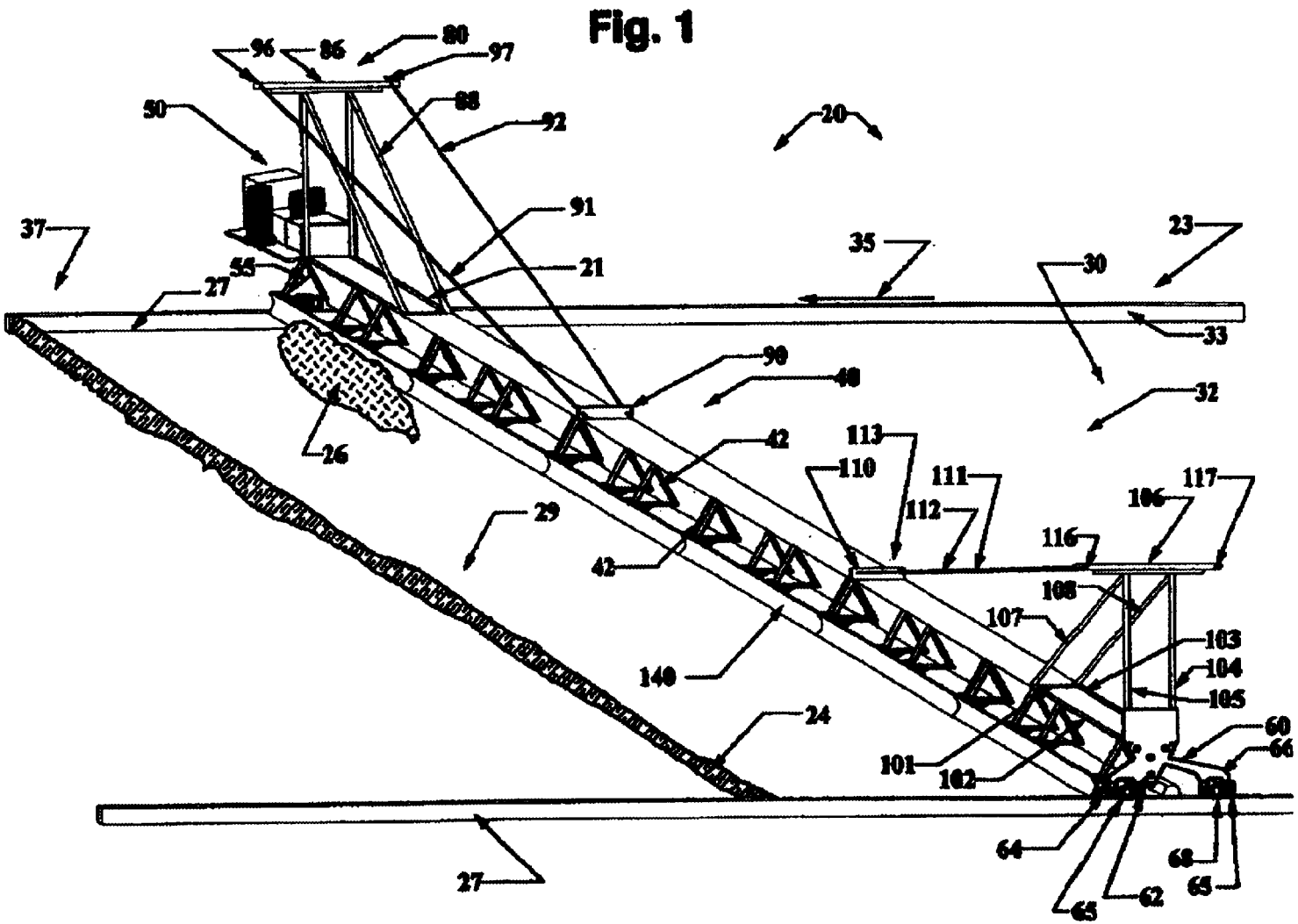
FIG. 1 is an environmental view taken generally from the front showing one exemplary embodiment of an inverted truss screed with outrigger support in accordance with the present invention with portions omitted or shown in section for clarity.
Figure 2:
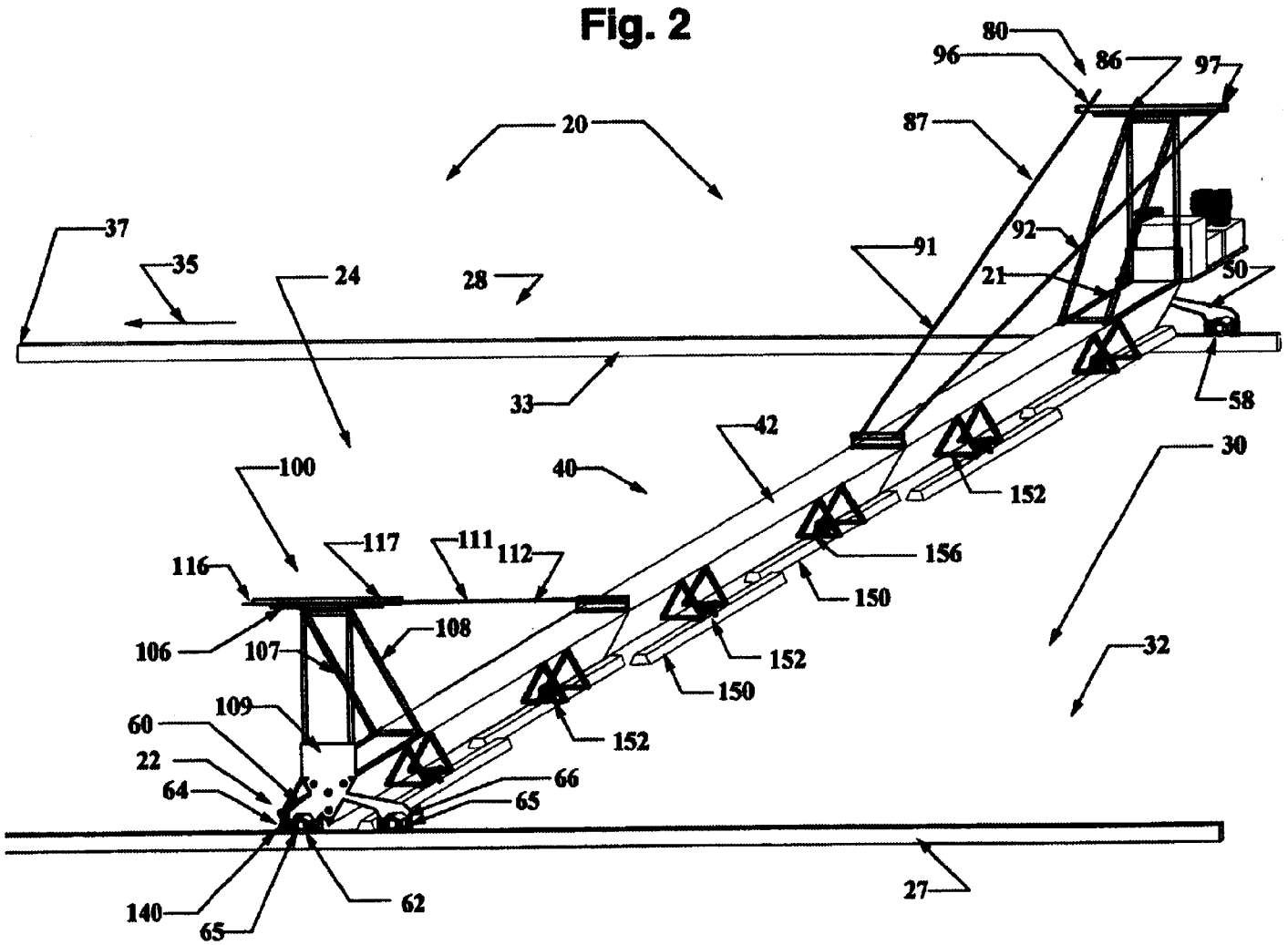
FIG. 2 is an environmental view taken generally oppositely from FIG. 1 with portions omitted or shown in section for clarity thereof.
Figure 3:
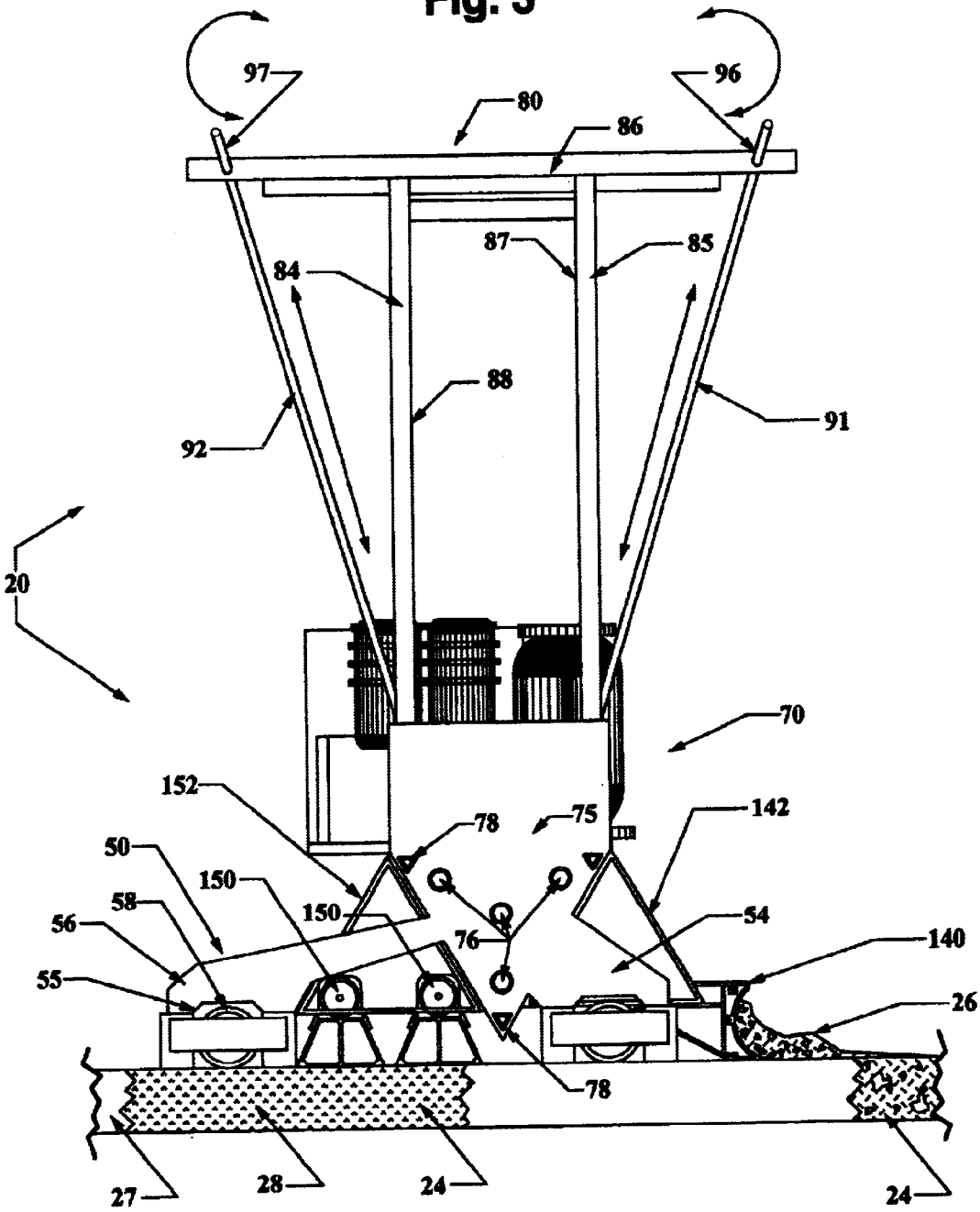
FIG. 3 is an end elevational view with portions omitted or shown in section for clarity thereof.

One exemplary embodiment of the inverted truss screed in accordance with the present invention is generally designated by reference numeral 20 in FIGS. 1–10. The screed 20 will be normally used at construction sites 23 where wet or "plastic" concrete 24 is being used to build roads, bridge decks, commercial building floors, and the like. The plastic concrete 24 is typically bounded by rigid forms 27 that define a pour area containing the plastic concrete 24 which is worked by screed 20 to form a finished concrete monolith 30. The top of the finished monolith 32 is commonly at the same level as the top of the forms 27. The forms 27 may also be used to support and guide the concrete screed 20 with attached finishing tools. Thus, the forms 27 support the riding concrete screed 20 permitting the screed 20 to span the concrete pour area 29 as it sits or rides atop the forms 27.

The concrete monolith 30 is made by first placing the containing and dimension defining forms 27. Then, fresh plastic concrete 24 is poured into the area 29 bounded by the forms 27. Any excess plastic concrete 24 is then removed before the consolidating or packing the plastic concrete 24 and finishing the surface of the plastic concrete. The next step is to work the plastic concrete 24 to remove air pockets or bubbles that may exist within plastic concrete 24. Finally, the packed and finished plastic concrete 28 cures into a solid monolith 30.

It needs to be stressed that the procedure just described is time critical in that as soon as water is added to the dry concrete mix the cement in the mix begins to react chemically and the plastic concrete 24 mix will only remain plastic and formable for a given time period before it hardens or "sets". The plastic concrete 24 only has the proper consistency for certain forming operations during shorter periods of the overall "setting" time.

On large commercial jobs such as one exemplified by FIG. 1, the forgoing steps are arranged to occur as a spatial sequence whose steps parallel the time sequence outlined herein. The concrete forming process begins at a first end 33 of the pour site and proceeds laterally in the direction indicated by the arrow identified by reference numeral 35 toward the other end 37. FIG. 1 shows the concrete pouring, consolidating and finishing processes after they have progressed sufficiently to yield a newly finished concrete monolith 32. Thus, the screed 20 traverses the forms 27 moving in the direction of arrow 35 over the freshly poured plastic concrete 24 while pushing excess plastic concrete 26 forward and packing or consolidating and smoothing or finishing all of the plastic concrete passing beneath the screed 20. Of course, other operations could be performed simultaneously as well with appropriate tooling for screed 20.

In operation, the screed 20 must be supported while it is propelled forward across the unfinished plastic concrete 24.

The screed 20 can ride on forms 27 or it can ride on finished, hardened concrete adjacent to the current pour that act as forms 28. This is an important mode of operation as it allows for the removal of forms 27 and the insertion of material for planned jointing of several concrete monoliths to accommodate the natural expanding and contracting of concrete monoliths thus preventing random cracking.

The screed 20 is propelled across the unfinished plastic concrete 24 either by self-propulsion or by retracting cables located at each end 21, 22 of the screed 20. The cables can be retracted manually or with other power sources such as hydraulically or electric motors or the like.

During a concrete pouring operation, plastic concrete 24 is deposited in front of the screed sufficiently fast to have a zone of slight excess 26 immediately in front of the screed 20. A crew of workers is spaced along the front of the screed 20. Their job is to ensure that this slight excess of plastic concrete 26 is continually maintained. This slight excess of plastic concrete 26 is maintained by manually moving plastic concrete 24 toward the screed 20 to create the excess 26 or dragging the plastic concrete 24 away from the screed 20 to reduce the excess 26 sufficiently to avoid problems associated with too large of an excess 26.

Screed operators or tenders normally are stationed at each end 21, 22 of the screed 20. The operators regulate the screed's forward movement. The operators also check and usually adjust the overall screed 20 pitch and/or alignment. The adjustment of the screed 20 for shaping the desired crown in the finished monolith 30 is a critical factor since an error in the finished monolith's crown is expensive and time-consuming to rectify.

The inverted truss concrete screed 20 has a central beam 40 extending between the ends 21, 22. The beam 40 includes at least one elongated modular section 42 and possibly several modular sections that are coupled together to form screed 20. Each module 42 supports concrete working and finishing tools as will be more fully discussed hereinafter.

Two outrigger systems 80, 100 stabilize the main truss beam 70 and facilitate adjustments to screed pitch and alignment for producing the desired crown on the finished concrete monolith 32. At the screed ends 21, 22 carriage assemblies 50, 60 support the truss screed 20 on forms 27. Optional attachments include auxiliary generators, hydraulic motors, and the like, which can be affixed to the end carriage units 50, 60 as needed.

The end carriages 50, 60 each include a body 52, 62 that directly supports the inverted truss screed 20 to support, stabilize and guide the screed 20 during operation. Each rear arm 56, 66 is longer than each fore arm 54, 64 to compensate for the pressure to tilt the screed 20 backward. The guide bars 55, 65 keep the load bearing wheels 58, 68 centered on forms 28 or other narrow supporting media. The wheels 58, 68 are exchangeable so that their properties best meet the requirements needed to be transported over the available support forms 27, i.e. rails, pipes, hardened flat concrete and the like. Each rear arm 56, 66 is arched above the vibratory packing and smoothing bar 150 so that the bar 150 can extend over form 27 allowing concrete to be finished to the very edge and utilizing the form 27 to establish the level of the finished concrete. Each front arm 54, 64 is short so that the leveling blade 140 can extend past the form 27 in front of any screed 20 parts. Not having any obstacles in front of the leveling blade 140 facilitates moving the plastic concrete 24 to maintain the proper excess immediately in front of the leveling blade 140.

The inverted truss screed 20 has a common geometric cross-sectional shape as well as dimension for connections between all abutting elements for facilitating component assembly. These coupling elements 70 are preferably internal to the perimeter of the main beam 40.

Each coupling 70 uses a common cross-sectional shape with that shape being an equilateral triangle defined in a terminal plate 75. Four holes 76 to receive coupling bolts are located centrally in each plate 75. Holes 78 with triangular peripheries are located proximate each of two adjacent sides in each plate 75 and can be advantageously ⅜ inch from each side. The inside dimensions of these triangular holes 78 can be the same as the inside dimensions obtained by welding three ⅛ inch thick by 1.5 inch wide steel plates in the cross-sectional form of an equilateral triangle although other dimensions will work acceptably. A short alignment tube 79 with a triangular cross section fits inside these holes 78 during assembly of components to serve as positioning guides to facilitate rapid assembly.

Each inverted truss beam section 42 has a plurality of equilateral triangles incorporated in its structure. Firstly, the main beam 40 has a cross section in the shape of an equilateral triangle. The frame 42 of the main beam 40 includes a ¼ inch steel plate for the coupling elements 70 at each end of each section 42. Each section's ends are connected with three triangular shaped framing members 43. These triangular framing members 43 are constructed by welding three ⅛ inch thick by 1.5 inch wide steel plates of the desired length together to form reinforcing strut 44 with a cross-sectional equilateral triangle shape. The ends of the framing members 43 form triangular shaped holes in the coupling element 70 and are welded so that the end of the framing member 43 and the surface of a respective coupling 70 are flush on the outside.

A web of triangles 45 function as a truss. The truss may be advantageously constructed from ⅜ inch steel rod along the sides of each section 42. These steel rods 45 are welded to the framing members 43 whenever they meet thus creating stiffing triangles located along the side (i.e. the truss). Attachments made via welding are the round steel rods 45 to the framing members 43, the round steel rods 45 to each other, and the framing member 43 to each end coupling 70.

The screed 20 is disassembled for moving by unbolting the coupling bolts placed in the holes 76 located at the end of each section 42 and the other screed components. The screed 20 sections 42 have a plurality of lengths ranging from 2.5 to 10 feet. There is also a quick connector for the vibrator 156 to facilitate fast assembly and disassembly.

The screed 20 is assembled by inserting the short metal guides 79 into holes 79 and pushing adjoining sections 42 and/or other screed components including the carriage assemblies 50, 60 and outrigger 80, 100 together. In this manner the bolting holes are quickly aligned and held in place for the subsequent bolt insertion. The outriggers 80, 100 are aligned similarly to facilitate quick assembly at the job site.

The concrete finishing tools 140, 150 are attached to the main beam 40 with braces 142, 152 that also serve as "quick connectors." An exemplary embodiment of the configuration of scraper blade 144, main beam 40, and smoothing bar 154 is shown in FIG. 1. The braces 142, 1,52 are attached to the main beam 40 at the reinforcing bands 44.

In one exemplary embodiment with a plurality of sections 42 comprising beam 40, a plurality of vibrator bars 154 for packing and smoothing the plastic concrete 24 are arranged in offset, overlapping rows. That is, the vibrator bars 154 in one row lap those in the other row. This overlap prevents surface imperfections such as ridges and seams. Individual vibrator units 156 are located in the center and on top of each vibrator bar 154. The vibrator unit 156 is composed of a waterproof electric motor that drives an offset cam to originate the vibrations.

While screed 20 moves forward, the vibrators 156 vigorously vibrate to cause the smoothing bar 154 to vibrate to pack and smooth the plastic concrete 24 resulting in a packed and smoothed concrete monolith 30. While the vibrations are necessary to pack and smooth the plastic concrete 24, their effect on the screed 20 is to shake it out of alignment. To minimize the deleterious effect of the vibrations on the screed 20, vibration dampeners can be installed between smoothing bar 154 and braces 152 as well as between braces 152 and beam 40. However, provision must still be made for periodic alignment of screed 20 to maintain a desirable alignment and pitch.

Figure 4:
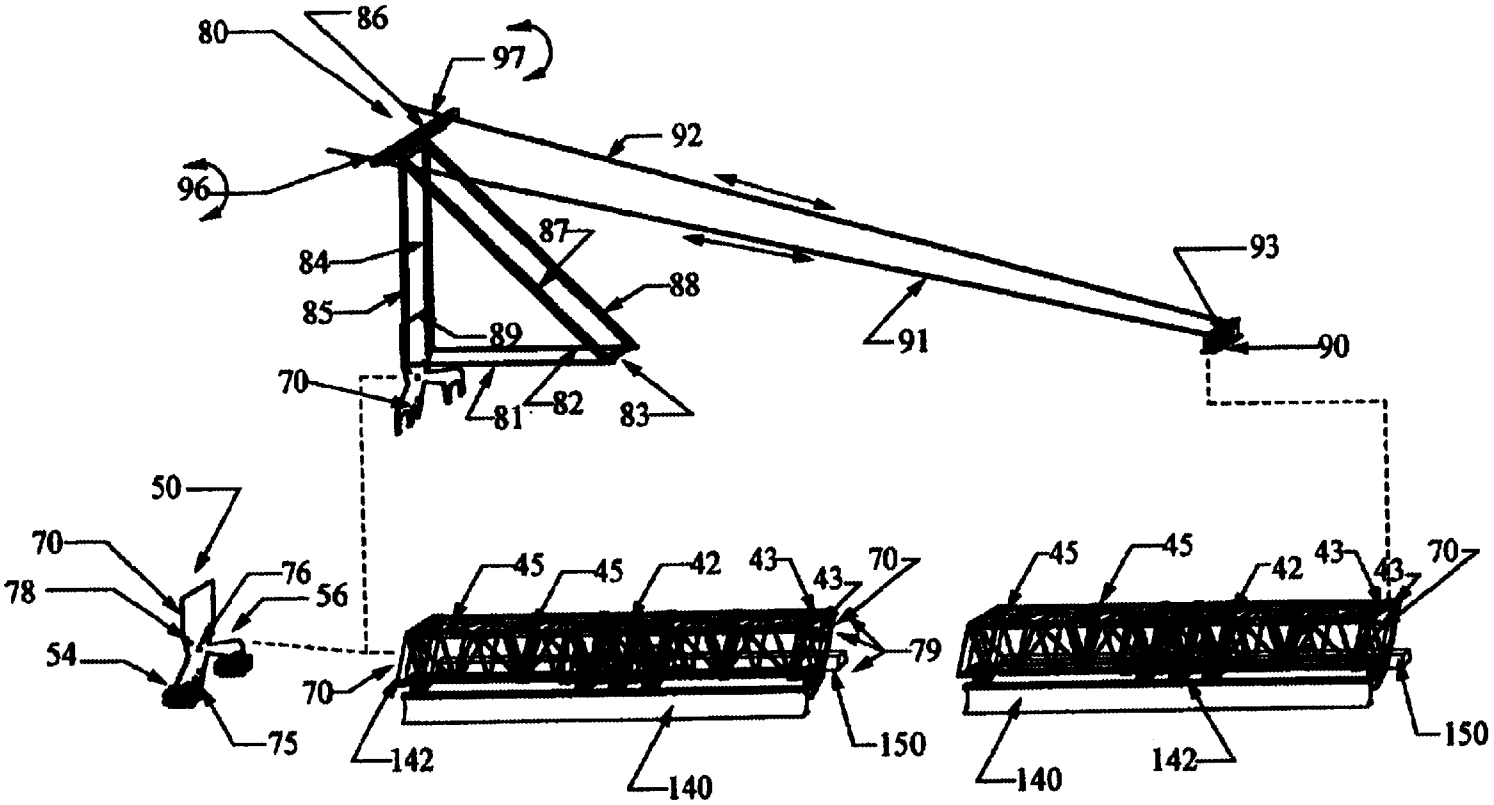
FIG. 4 is a partially exploded perspective view of the outrigger support, carriage assembly and a portion of the beam for the screed with portions omitted or shown in section for clarity thereof.

An enlarged view of one of the outriggers 80 is shown in FIG. 4. The outrigger 80 has base bars 81, 82 which form support as well as connectors for spacing bar 83 and vertical stanchions 84, 85. The tops of the vertical stanchions 84, 85 are connected to a spacing bar 86 that also serves as the attachment point for connecting bars 87, 88. These components together form a front and rear triangle joined by spacing bars 83, 86 and stabilizer plate 89. Stabilizer plate 89 is an extension of the triangular shaped mounting plate 70 and extends ⅓ the distance up the vertical stanchions 84, 85 to provide sufficient space for attaching the stanchions 84, 85 to its edges. Spacing bar 86 extends laterally past the vertical stanchions 84, 85 to provide for attaching connecting rods 91, 92 that are attached to bar-clamp 90. The outrigger arms 91, 92 are usually made with steel rods that bolt onto the top crossbar 93 of the bar-clamp 90.

The outrigger assembly 80 is attached toward the screed's middle using bar clamp 90. The upper crossbar 93 is placed atop the two upper main beam 40 frame members 43 with the lower crossbar 94 placed below these frame members 43. The clamp placement is also chosen so that a reinforcing strut 44 is adjacent to a clamp 90 and prevents the clamp 90 from sliding toward the ends 21 or 22. Upper and lower cross bars 93, 94 are clamped to the framing members 43 with bolts on either side of each framing members 43. The exact attachment location relative to the outrigger assembly 80 is dependent on the overall width of the assembled screed 20 and is generally greater than ⅓ but less than ½ the length of the assembled main beam.

The second outrigger 100 is similar to outrigger 80 but it is located oppositely on screed 20. Outrigger 100 has base bars 101, 102 which form support as well as connectors for spacing bar 103 and vertical stanchions 104, 105. The tops of the vertical stanchions 104, 105 are connected to a spacing bar 106 that also serves as the attachment point for connecting bars 107, 108. These components together form a front and rear triangle joined by spacing bars 103, 106 and stabilizer plate 109. Stabilizer plate 109 is an extension of the triangular shaped mounting plate 70 and extends ⅓ the distance up the vertical stanchions 104, 105 to provide sufficient space for attaching the stanchions 104, 105 to its edges. Spacing bar 106 extends laterally past the vertical stanchions 104, 105 to provide for attaching connecting rods 111, 112 that are attached to bar-clamp 110. The outrigger arms 111, 112 are usually made with steel rods that bolt onto the top crossbar 113 of the bar-clamp 110.

The outrigger assembly 100 is attached toward the screed's middle using bar clamp. The upper crossbar 113 is placed atop the two upper main beam 40 frame members 43 with the lower crossbar 114 placed below these frame members 43. The clamp placement is also chosen so that a reinforcing strut 244 is adjacent to a clamp 110 and prevents the clamp 110 from sliding toward the ends 21 or 22. Upper and lower cross bars 113, 114 are clamped to the framing members 43 with bolts on either side of each framing members 243 The exact attachment location relative to the outrigger assembly 100 is dependent on the overall width of the assembled screed 20 and is generally greater than ⅓ but less than ½ the length of the assembled main beam.

The outriggers 80, 100 both sit atop the inverted triangular trussed beam 40. The support bars 81, 82, 101, 102 are aligned with the two upper frame members 43 of the beam 40. The triangular attachment coupling plates 75 are attached to the terminus of the main beam 40 using bolts that pass through the matching bolt holes in the outrigger attachment plates 75 and in the main screed beam 40 coupling plates 75.

Each of the arms 91 and 111 is shortened or lengthened by use of adjuster 96 and 116, this adjustment results in a lifting or lowering action (See FIGS. 7–10), respectively, at the point of attachment to the bar clamps 90, 110. Similarly a lifting or lowering action is obtained at the point of connection of arm 92 and 112 by using adjuster 97 and 117. In one exemplary embodiment, adjusters 96, 97, 116 and 117 are threaded bolts although other conventional devices could be used for adjustment as well.

Although when adjusting the front or back there is some resultant force on the other side of the screed beam 40, sufficient slack exists for limited independent front-side or rear-side adjustment. This is important as torsion on the main screed beam 40, arising from imbalances in the manner of operation of the fore and aft concrete finishing tools 140, 150, often times makes it necessary to raise or lower either the front or rear to maintain proper adjustment of the overall screed main beam 40 (as can be seen in FIGS. 7–8).

At the opposite end of the screed 20, arm 91 and 11 is shortened or lengthened by use of adjuster 96, 116, this adjustment results in a lifting or lowering action, respectively, at the point of attachment to the bar clamp 90, 110. Similarly a lifting or lowering action is obtained at the point of connection of arm 92 and 112 by using adjuster 97 and 117.

Figure 7:
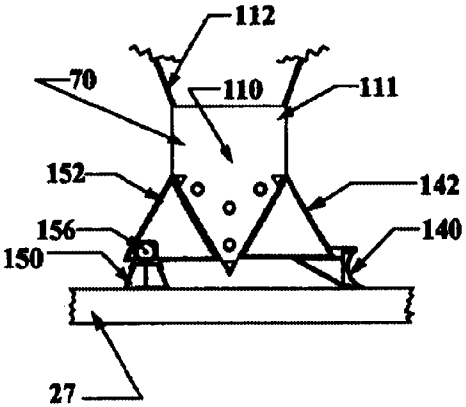
FIG. 7 is side elevational view thereof.
Figure 8:
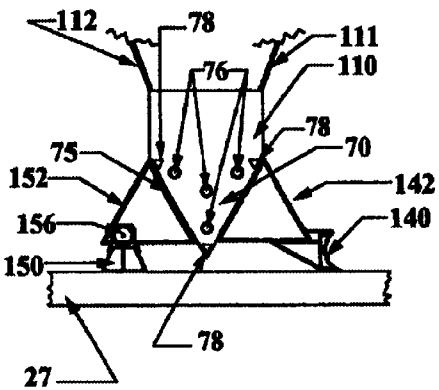
FIG. 8 is side elevational view thereof showing a moved position.
Figure 5:
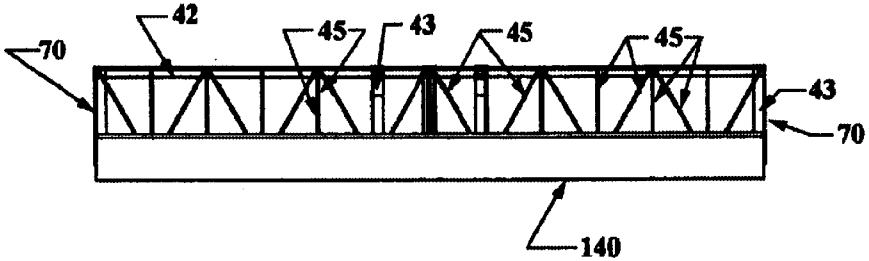
FIG. 5 is an enlarged front elevational view of one section of the screed with portions omitted or shown in section for clarity.
Figure 6:
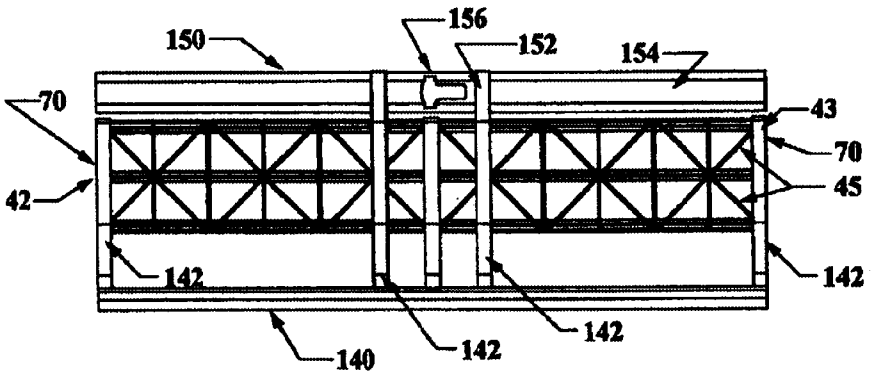
FIG. 6 is a top plan view thereof.
Figure 9:
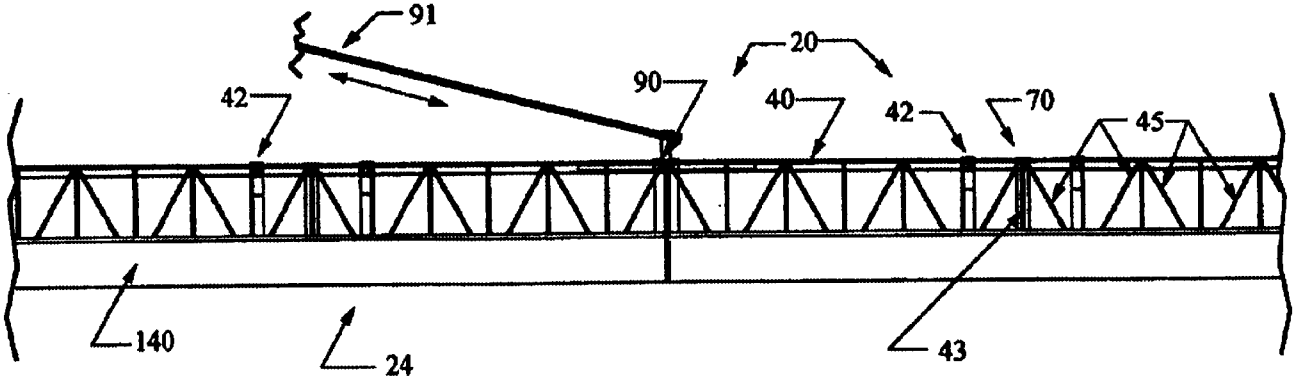
FIG. 9 is a front elevational view of a portion of the screed with portions omitted or shown in section for clarity; and, FIG. 10 is a front elevational view similar to FIG. 9 showing a moved position.
Figure 10:
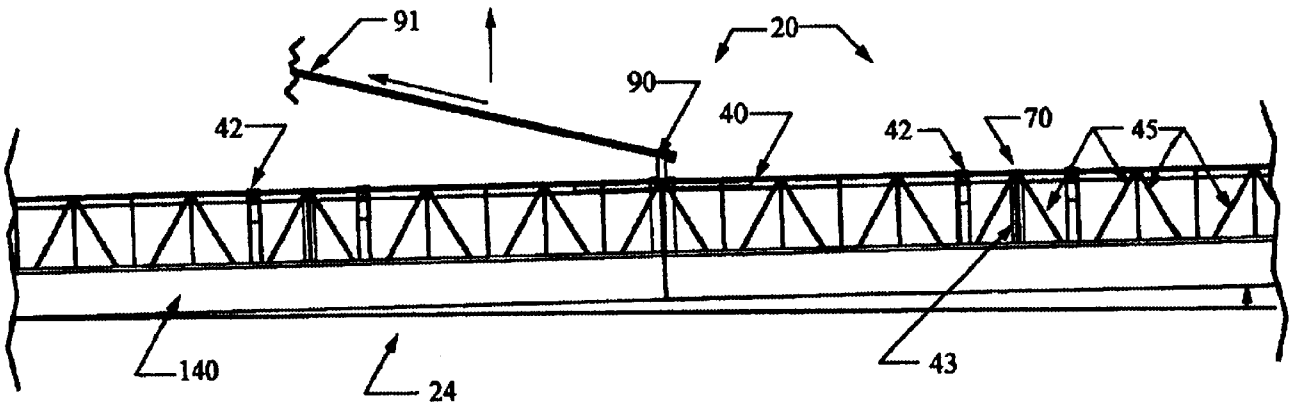

Thus it is possible with the outriggers 80, 100 to adjust each end to affect the screed's pitch by lifting at their respective screed attachments proximate the middle of the screed 20 (FIGS. 9–10) as well as the front and back of the screed independently to affect the screed's alignment (FIGS. 7–8). The placement of the adjusting mechanisms 96, 97, 116 and 117 is such that an operator standing at either end 21, 22 of the screed 20 can adjust the screed from his monitoring position.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A concrete screeding apparatus supporting tools for working and finishing plastic concrete bounded by at least two spaced apart rigid forms at a construction site, said apparatus comprising:

at least two spaced apart carriages adapted to support said apparatus above the plastic concrete while traversing the forms at the site;

an elongated trussed beam supporting said tools and extending between said carriages, said beam having a cross-section with a triangular outline with a base and an apex, and wherein said beam comprises a plurality of modular sections and wherein each of said sections includes finishing tools secured thereto, and said beam supported between said carriages to orient said outline such that said apex is proximate the plastic concrete as said apparatus traverses the forms; and, at least two spaced apart adjustable outriggers adapted to make alignment and pitch adjustments to said apparatus, said outriggers being adjustable proximate said carriages to enable apparatus alignment and pitch adjustments exteriorly to the plastic concrete.

2. The apparatus as recited in claim 1 wherein said finishing tools are coupled to said beam using brackets having a triangular cross-sectional outline.

3. The apparatus as recited in claim 2 wherein said finishing tools are selected from the group including a strike-off, a float, a pan, a scraper, and an agitator.

4. The apparatus as recited in claim 2 wherein said tools are vibrationally isolated from said beam.

5. The apparatus as recited in claim 4 wherein said tools comprise a front scraper proximate the front of said beam and a rear vibratory bar proximate the rear of said beam and said bar has means for vibrating secured thereto.

6. The apparatus as recited in claim 2 wherein said tools are coupled to said beam proximate the perimeter of said beam to reduce torsion stress on said beam.

7. The apparatus as recited in claim 1 wherein said beam comprises a plurality of modular sections and wherein each of said sections includes at least two alignment guides adapted to facilitate coupling of abutting sections.

8. The apparatus as recited in claim 1 wherein said outriggers adjust said beam upward or downward with respect to the plastic concrete at a plurality of discrete locations and said outriggers are adapted to be adjusted without interrupting traversal.

9. A concrete screeding apparatus supporting tools for working and finishing plastic concrete bounded by at least two spaced apart rigid forms at a construction site, said apparatus comprising:

at least two spaced apart carriages adapted to support said apparatus above the plastic concrete while traversing the forms at the site;

an elongated trussed beam supporting said tools and extending between said carriages, said beam having a cross-section with a triangular outline with a base and an apex, and said beam supported between said carriages to orient said outline such that said apex is proximate the plastic concrete as said apparatus traverses the forms and wherein said beam comprises a plurality of modular sections and wherein each of said sections includes at least two alignment guides adapted to facilitate coupling of abutting sections; and, at least two spaced apart adjustable outriggers adapted to make alignment and pitch adjustments to said apparatus, said outriggers being adjustable proximate said carriages to enable apparatus alignment and pitch adjustments exteriorly to the plastic concrete.

10. The apparatus as recited in claim 9 wherein each of said sections includes finishing tools secured thereto.

11. The apparatus as recited in claim 10 wherein said finishing tools are coupled to said beam using brackets having a triangular cross-sectional outline.

12. The apparatus as recited in claim 11 wherein said finishing tools are selected from the group including a strike-off, a float, a pan, a scraper, and an agitator.

13. The apparatus as recited in claim 10 wherein said tools are vibrationally isolated from said beam.

14. The apparatus as recited in claim 10 wherein said tools comprise a front scraper proximate the front of said beam and a rear vibratory bar proximate the rear of said beam and said bar has means for vibrating secured thereto.

15. The apparatus as recited in claim 14 wherein said tools are coupled to said beam proximate the perimeter of said beam to reduce torsion stress on said beam.

16. The apparatus as recited in claim 10 wherein said outriggers adjust said beam upward or downward with respect to the plastic concrete at a plurality of discrete locations and said outriggers are adapted to be adjusted without interrupting traversal.

17. A concrete screeding apparatus supporting tools for working and finishing plastic concrete bounded by at least two spaced apart rigid forms at a construction site, said apparatus comprising:

at least two spaced apart carriages adapted to support said apparatus above the plastic concrete while traversing the forms at the site;

said bean elongated trussed beam supporting said tools and extending between said carriages, said beam having a cross-section with a triangular outline with a base and an apex, and said beam supported between said carriages to orient said outline such that said apex is proximate the plastic concrete as said apparatus traverses the forms and wherein said beam comprises a plurality of modular sections and wherein each of said sections includes at least two alignment guides adapted to facilitate coupling of abutting sections and wherein each of said sections includes finishing tools secured thereto and wherein said tools are coupled to said beam proximate the perimeter of said beam to reduce torsion stress on said beam; and, at least two spaced apart adjustable outriggers adapted to make alignment and pitch adjustments to said apparatus, said outriggers being adjustable proximate said carriages to enable apparatus alignment and pitch adjustments exteriorly to the plastic concrete and wherein said outriggers adjust said beam upward or downward with respect to the plastic concrete at a plurality of discrete locations and said outriggers are adapted to be adjusted without interrupting traversal.

18. The apparatus as recited in claim 17 wherein said finishing tools are coupled to beam using brackets having a triangular cross-sectional outline.

19. The apparatus as recited in claim 18 wherein said finishing tools are selected from the group including a strike-off, a float, a pan, a scraper, and an agitator.

* * * * *